US011313515B1

(12) United States Patent
Vinjamuri

(10) Patent No.: US 11,313,515 B1
(45) Date of Patent: Apr. 26, 2022

(54) BOIL-OFF GAS HANDLING IN LNG TERMINALS

(71) Applicant: Vinjamuri Innovations, LLC, Woodbridge, VA (US)

(72) Inventor: Gopala Krishna Vinjamuri, Ashburn, VA (US)

(73) Assignee: Vinjamuri Innovations, Inc., Ashburn, VA (US)

( * ) Notice: Subject to any disclaimer, the term of this patent is extended or adjusted under 35 U.S.C. 154(b) by 0 days.

(21) Appl. No.: 17/343,333

(22) Filed: Jun. 9, 2021

(51) Int. Cl.

| | |
|---|---|
| ***F17C 5/06*** | (2006.01) |
| ***F17C 5/02*** | (2006.01) |
| ***F17C 1/00*** | (2006.01) |
| ***F17C 13/00*** | (2006.01) |
| ***F17C 1/12*** | (2006.01) |
| ***F17C 1/06*** | (2006.01) |

(52) U.S. Cl.
CPC ..... *F17C 5/02* (2013.01); *F17C 1/005* (2013.01); *F17C 1/06* (2013.01); *F17C 1/12* (2013.01); *F17C 5/06* (2013.01); *F17C 13/002* (2013.01); *F17C 2201/0109* (2013.01); *F17C 2203/0329* (2013.01); *F17C 2203/0604* (2013.01); *F17C 2203/0636* (2013.01); *F17C 2203/0673* (2013.01); *F17C 2221/033* (2013.01); *F17C 2223/0161* (2013.01); *F17C 2227/0135* (2013.01); *F17C 2227/0157* (2013.01); *F17C 2265/037* (2013.01); *F17C 2270/0168* (2013.01)

(58) Field of Classification Search
CPC .... F17C 5/02; F17C 1/005; F17C 1/06; F17C 1/12; F17C 13/002; F17C 2203/0329; F17C 2265/037; F17C 2225/036
See application file for complete search history.

(56) References Cited

U.S. PATENT DOCUMENTS

| | | | |
|---|---|---|---|
| 2,968,161 | A | 1/1961 | Bliss |
| 5,535,912 | A | 7/1996 | Fritz et al. |
| 6,733,563 | B2 | 5/2004 | Fujita et al. |
| 8,474,647 | B2 | 7/2013 | Vinjamuri |
| 8,783,041 | B2 | 7/2014 | Hartono et al. |
| 9,057,483 | B2 * | 6/2015 | Espinosa-Loza ..... F17C 1/00 |
| 9,574,707 | B2 | 2/2017 | Kim et al. |
| 10,627,049 | B2 | 4/2020 | Schimenti et al. |

(Continued)

FOREIGN PATENT DOCUMENTS

WO WO-2005047761 A1 * 5/2005 ..... F25J 1/005

*Primary Examiner* — John F Pettitt, III
(74) *Attorney, Agent, or Firm* — Louis Ventre, Jr.

(57) ABSTRACT

A process for collection, storage and transport of boil off-gas from a liquefied natural gas storage tank. An ultra-low temperature, composite gas tank is provided to accept the boil-off gas and saturated vapor at ultra-low-temperatures in a range of about −80° C. to −45° C. (about −112° F. to −229° F.) and at high pressure of about 150 bar (about 2,175.5 psi). Boil off gas collected from liquefied natural gas storage at a pressure in a range of about 15 to 18 bar (217.5 psi to 261 psi) and at a temperature in of about −150° C. (about −238° F.). The ultra-low temperature, composite gas tank can hold the gas as it warms to ambient temperature. The process includes a liner step; a filament step; a wrap step; and a filling step. Optional steps include an insulation step; a fiber step; a layering step; a nozzle step; and a gas step.

5 Claims, 8 Drawing Sheets

(56) References Cited

U.S. PATENT DOCUMENTS

| | | | | |
|---|---|---|---|---|
| 2014/0191499 | A1* | 7/2014 | Campbell | B65B 3/04<br>280/837 |
| 2015/0267866 | A1* | 9/2015 | Varrassi | F17C 1/14<br>220/560.11 |
| 2018/0003344 | A1* | 1/2018 | Poorman | F17C 5/007 |

* cited by examiner

A COMPRESSED GAS ALUMINUM CYLINDER IS FILLED WITH CNG AT P BAR PRESSURE AND T DEG C

GIVEN:

M = 16.04 GM/MOL, R=0.0821 T =C+273 DENSITY =M.P/(R.T) LNG Density is 468 gms/ltr

| P | T | | M | R | | 'LNG is filled to only 90% of Cylinder volume | | | |
|---|---|---|---|---|---|---|---|---|---|
| PRES-SURE | TEMPERATURE | | MOLECULAR WEIGHT | UNIVERSAL GAS CON-STANT | ROH | VOLU-METRIC DENSITY | CYL. VOL-UME | GAS WEIGHT | |
| BAR | DEG C | DEG K | grams/mol | Ltr.Atm | gm/Ltr | KG/LTR | LTR | KG | WT. % LIQID |
| 50 | -145 | 128 | 18.00 | 0.0821 | 85.64 | 0.09 | 100.00 | 8.56 | 19.82 |
| 100 | -145 | 128 | 18.00 | 0.0821 | 171.29 | 0.17 | 100.00 | 17.13 | 39.65 |
| 150 | -145 | 128 | 18.00 | 0.0821 | 256.93 | 0.26 | 100.00 | 25.69 | 59.47 |
| 50 | -100 | 173 | 18.00 | 0.0821 | 63.37 | 0.06 | 100.00 | 6.34 | 14.67 |
| 100 | -100 | 173 | 18.00 | 0.0821 | 126.73 | 0.13 | 100.00 | 12.67 | 29.34 |
| 150 | -100 | 173 | 18.00 | 0.0821 | 190.10 | 0.19 | 100.00 | 19.01 | 44.00 |
| 100 | -100 | 173 | 18.00 | 0.0821 | 126.73 | 0.13 | 100.00 | 12.67 | 29.34 |
| 150 | -80 | 193 | 18.00 | 0.0821 | 170.40 | 0.17 | 100.00 | 17.04 | 39.44 |
| 100 | -80 | 193 | 18.00 | 0.0821 | 113.60 | 0.11 | 100.00 | 11.36 | 26.30 |
| 50 | -80 | 193 | 18.00 | 0.0821 | 56.80 | 0.06 | 100.00 | 5.68 | 13.15 |
| 50 | -40 | 233 | 18.00 | 0.0821 | 47.05 | 0.05 | 100.00 | 4.70 | 10.89 |
| 100 | -40 | 233 | 18.00 | 0.0821 | 94.10 | 0.09 | 100.00 | 9.41 | 21.78 |
| 150 | -40 | 233 | 18.00 | 0.0821 | 141.14 | 0.14 | 100.00 | 14.11 | 32.67 |
| 50 | 0 | 273 | 18.00 | 0.0821 | 40.15 | 0.04 | 100.00 | 4.02 | 9.30 |
| 100 | 0 | 273 | 18.00 | 0.0821 | 80.31 | 0.08 | 100.00 | 8.03 | 18.59 |
| 150 | 0 | 273 | 18.00 | 0.0821 | 120.46 | 0.12 | 100.00 | 12.05 | 27.89 |

FIG.10

BOIL-OFF GAS HANDLING IN LNG TERMINALS

TECHNICAL FIELD

In the field of cryogenic fluids, such as liquefied natural gas (LNG), a process for storing, and subsequently transporting, boil-off gas (BOG) and saturated vapor initially at ultra-cold temperatures and permitting the stored gas to warmup to ambient temperature within a specialized storage tank.

BACKGROUND ART

Natural gas contains over 95% of the chemical methane. The remainder gases are considered heavier hydrocarbons, such as ethane, propane, and butane. After combustion, natural gas and the residual emissions are significantly less polluting than crude oil, reformed gasoline, and diesel.

Prior to combustion, however, significant quantities of methane enters atmosphere from chemical processing plants (refineries), and natural gas supply chain from well to wheel.

According a Clean Air Task Force White Paper 2020 update, methane is a highly potent greenhouse gas, which pound per pound warms the climate dozens of times more than carbon dioxide. Methane emission from various oil and natural gas production and storage facilities is estimated to be 11,825,000 metric tons by 2025. Presently, methane gas releases are warming our climate about half as much as carbon dioxide. The Energy Information Agency (EIA) of the U.S. Government reports that natural gas when released is a far greater contributor to global warming than is carbon dioxide. So, it is important to minimize the release of natural gas whenever possible.

The methods disclosed for storage and transportation is an impactful solution to mitigate methane emissions from liquefied natural gas storage and transportation and to diminish resulting product loss through the supply chain.

In response to growing concerns over warming temperatures and other harmful effects from greenhouse gas pollution, in addition to the extremely rapid growth of oil and gas production in the United States over the past decade, many jurisdictions in the U.S. and elsewhere in North America have moved to reduce methane emissions from oil and gas by implementing regulations that require oil and gas operators to use equipment and practices that have been shown to reduce greenhouse gas emissions.

Given the urgency of the climate crisis, the United States Environmental Protection Agency is taking steps to regulate methane emissions from new and existing oil and natural gas sites, nationwide. Internationally, the United Nations published an assessment that by 2025, methane emissions in United States could be reduced from 11.8 million metric tons to about by 7.8 million metric tons. If implemented, this effort would be equivalent to reducing 680 million metric tons of carbon dioxide emissions in the United States. The United Nation's assessment determined that such a reduction would prevent nearly 0.3 degrees Celsius in global warming by 2045. The Global Methane Assessment was conducted by the United Nation Environment Program and the Climate and Clean Air Coalition.

Per United Nation Environment Program Executive Director Inger Andersen, "Cutting methane is the strongest lever we have to slow climate change over the next 25 years and complements necessary efforts to reduce carbon dioxide."

Transporting liquefied natural gas is a growing industry. A U.S. Energy Information Administration's Annual Energy Outlook 2021 reference case indicates that United States liquefied natural gas exports are expected to continue to grow throughout the 2020s, reaching 13.7 billion cubic feet per day (Bcf/d) after 2030. Liquefied natural gas exports vary across cases from approximately 8 billion cubic feet per day (Bcf/d) to more than 27 Bcf/d, which is predominantly dependent on crude oil and domestic natural gas prices. So, a technology and methodology as presently disclosed herein, that is both less expensive than existing best practice technologies and mitigates methane gas releases, has a significant potential for environmental and public health benefit.

Liquefied natural gas export facilities receive natural gas by pipeline and liquefy the gas for transport on special ocean-going liquefied natural gas ships or tankers. Most liquefied natural gas is transported by tankers called liquefied natural gas carriers in large, onboard, super-cooled and insulated (cryogenic) tanks. In the liquefaction process, natural gas is condensed into a liquid at close to atmospheric pressure by cooling it to approximately −162° C. (−260° F.) at a maximum transport pressure of about 25 kPa (4 pounds per square inch (psi)). At every step in the process where liquefied natural gas is pumped to a different container, there is potential for methane gas release.

While the cryogenic tanks on a liquefied natural gas carrier are designed to stay cool, they cannot provide perfect insulation against warming. Heat flow towards the inner tank slowly causes the liquefied natural gas inside to evaporate and produce boil-off gas.

Natural gas remains liquefied by staying at a consistent pressure, but when boil-off occurs as the liquid returns to gas, the larger volume of gas will increase the tank pressure. While the tanks may be designed to handle the rise over short distances, prolonged pressure increases cannot be managed effectively and requires alternative solutions, such as frequently venting the boil-off gas, which is the general best practice at present.

SUMMARY OF INVENTION

A process for collection, storage and transport of boil off-gas from a liquefied natural gas storage tank. An innovative ultra-low temperature, composite gas tank is provided to accept the boil-off gas and saturated vapor at ultra-low-temperatures in a range of about −80° C. to −45° C. (about −112° F. to −229° F.) and at high pressure of about 150 bar (about 2,175 psi). Boil off gas and saturated vapor collected from liquefied natural gas storage at a pressure in a range of about 15 to 18 bar (217 psi to 261 psi) and at a temperature in of about −150° C. (about −238° F.).

The BOG and saturated vapor, as collected, is further processed resulting in a product gas that is at an ultra-cold temperature of about −100° C. (−148° F.) and at a pressure of about 150 bar (about 2,175 psi). The ultra-cold temperature gas is filled into the disclosed ultra-low temperature, composite gas tank up to a designated weight.

The filled ultra-low temperature, composite gas tank can thereafter store the ultra-cold temperature gas safely even when the stored gas reaches ambient temperature. No further repackaging of the methane gas for safe transport or storage is needed. The time for the temperature to rise to ambient temperature and corresponding design service pressure can be extended when the ultra-low temperature, composite gas tank is insulated.

The process starts with the provision of a "Metallic Liner with Metal End Caps for a Fiber Wrapped Gas Tank described in U.S. Pat. No. 8,474,647, issued 2 Jul. 2013 to applicant, which is hereby incorporated by reference in its entirety.

The process then adds a composite wrapping to the metallic liner to reinforce it. Preferably, the overwrap is a structural fiber-epoxy composite fully covering the liner, end to end with a combination of hoop and helical winding. Preferably, the wrap is applied in multiple layers. Thermal insulation material is preferably added. The thermal insulation material is preferably interspersed between any two layers of the composite wrapping. The composite wrapping is preferably strengthened with one or more of carbon fiber, fiber glass, aramid, KEVLAR and nylon. The wrapped metallic liner is called an ultra-low temperature, composite gas tank because the gas within starts at near cryo-temperatures and may be allowed to warm up to ambient temperature and high pressure.

The ultra-low temperature, composite gas tank may be used alone or bundled and inter-connected into a multiplexed arrangement.

Technical Problem

Currently available industrial gas transportation tanks are for compressed gas at ambient temperatures, or are double-walled, vacuum and super-insulated cryogenic cargo tanks, super-insulated rail tank-cars, or small dewars.

An alternate fuel supply chain and transportation infrastructure is needed for more efficient gas tanks to transport large quantities of alternate fuels including boil off gas from a liquefied natural gas ship to eliminate re-refrigeration or other vaporization equipment aboard ships and at liquefied natural gas transfer facilities. Such an alternative would reduce climate change emissions of methane gas and carbon dioxide.

What is needed are lighter, safer and cost-effective transportation in easily equipped vehicles so that greenhouse gas emissions from gas transport can be minimized.

Storage and transport of boil-off gas needs a process employable with low capital expenditures and low operating expenses. Present gas transportation involves large, capital-intensive delivery-receiving equipment, large gas storage tanks, and large transportation vehicles. These are typically unsuitable for small end users. What is needed is a supply chain, including a product storage and transportation system that can be flexibly tailored to suit smaller and differing end user needs to minimize the product losses and the release of climate change gases.

Solution to Problem

The ultra-low temperature, composite gas tank according to the disclosure herein is designed to hold saturated vapor and boil-off gas at ultra-low temperatures near to cryogenic liquid temperature, and at relatively modest pressures so that the payload capability is comparable to a cryogenic tank, with advantage of preventing boil-off gas and product loss. Importantly, the ultra-low temperature, composite gas tank can hold the gas when the gas is at low temperatures, as well as when the gas temperature warms to ambient conditions.

The present invention has solved the problems on a small scale. In the process, boil-off gas starts out at ultra-cold temperatures in a range of about −80 to ~145 degrees Centigrade (° C.) (about −112° F. to about −229° F.)). The temperature range is approximate because the liquefaction temperature varies for the different boil off gases for which the disclosed processes may be used.

This boil-off gas is added to the ultra-low temperature, composite gas tank according to the disclosure, which can hold the gas at low temperatures and can hold the gas as it gradually warms to room temperature, resulting in reaching the tank design service pressure.

Boil-off gas would no longer have to be released, re-liquefied, used as fuel or burned in a gasification unit. Avoiding release of methane would also avoid urban climate change associated with the traditional transportation solutions.

The solution made possible by the ultra-low temperature, composite gas tank that utilizes the disclosed system and method of fabrication. The ultra-low temperature, composite gas tank has an aluminum liner with a composite (fiber-resin) precisely wrapped to cover the liner end-to-end. It is a Type 3 cylinder for storing and transporting gases initially at ultra-cold gas temperatures. The cylinder is designed to permit the gas stored inside to warm to ambient temperature (~25° C. or 77° F.) and design service pressure.

For the purposes of application to various cryogenic fluids, such as liquid hydrogen, the ultra-low temperature composite gas tank can be designed for sustainable potential pressures up to 1000 bar or 14500 psi.

This capability is suited to liquefied natural gas storage where boil-off gas starts off at ultra-cold temperatures (above −162° C. or −259° F.) typically found in the vicinity of a liquid surface in a liquefied natural gas tank and at about −150° C. (238° F.) in the vicinity of a boil-off gas vent valve. The ability to safely contain the gas at ultra-low temperatures and as well up to ambient temperature and high pressures is what makes this the ultra-low temperature, composite gas tank a desirable product.

In order to sustain pressure and temperature cycling with significant temperature swings, the ultra-low temperature, composite gas tank utilizes an inner, load-sharing liner equipped with structural end caps, as described in the applicant's earlier U.S. Pat. No. 8,474,647 B2, noted above.

The composite wrap is applied fully covering the metallic liner with end caps in a combination of hoop and helical windings, preferably so that each layer is wound at a different angle of wrap to achieve optimized structural design. The filament is preferably composed of a plurality of individual fibers impregnated with either a thermosetting or thermoplastic resin that fully overwraps the single-wall liner in layers of circumferential (hoop) and helical windings. The composite wrap preferably includes a plurality of load sharing and/or non-load sharing thermal insulation fibers to minimize heat transport into the inner space of the ultra-low temperature, composite gas tank. In a preferred embodiment, thermal insulation fibers occupy at least one layer that is interspersed in the filament reinforcement layers so as to slow the rate of heat transfer into the inner space of the ultra-low temperature, composite gas tank.

Multiple ultra-low temperature, composite gas tanks can be securely bundled together and interconnected with tubing, valves, pressure relief devices, and other appurtenances.

The storage configuration may take on a variety of configurations to suit the containment structures, such as tube trailers, refrigerated cargo vans, portable tanks, rail tank-car frames, ISO frames, etc.

Advantageous Effects of Invention

The innovative process disclosed herein eliminates or minimizes methane emissions from liquefied natural gas transportation systems, and this effect is part of the "now needed" solution with impactful contribution to environmental and climate change control and measureable societal benefits.

The ultra-low temperature, composite gas tank according to the disclosure herein is a much needed addition to the alternate fuel supply chain and to transportation infrastructure.

The ultra-low temperature, composite gas tank according to the disclosure herein provides a lighter, safer and cost effective means for transportation high-density, ultra-cold gas and for storage of that same gas as it warms to ambient temperature.

The ultra-low temperature, composite gas tank according to the disclosure herein enables methane emission mitigation because it avoids the need for venting, re-refrigeration or flaring of boil off gas from liquefied natural gas storage.

The ultra-low temperature, composite gas tank according to the disclosure herein enables lower capital expenditures and lower operating expenses for product transfer from source to transportation vehicles to the end user. Thus, the methods disclosed herein are advantageous not only towards minimizing boil-off gas emission, but also for adding to the profitability by eliminating product loss.

The ultra-low temperature, composite gas tank according to the disclosure herein provides maximal flexibility for gas storage and transportation because the ultra-low temperature, composite gas tanks may be structurally arranged in configurations to suite end user needs.

BRIEF DESCRIPTION OF DRAWINGS

The drawings illustrate preferred embodiments of the method of boil-off gas and saturated vapor handling in liquefied natural gas terminals and the components used in the method. The reference numbers in the drawings are used consistently throughout. New reference numbers in FIG. 2 are given the 200 series numbers. Similarly, new reference numbers in each succeeding drawing are given a corresponding series number beginning with the figure number.

FIG. 10 is a chart listing compressed natural gas possible time-temperature-quantity combinations storage and transportation in the ultra-low temperature, composite gas tank.

DESCRIPTION OF EMBODIMENTS

In the following description, reference is made to the accompanying drawings, which form a part hereof and which illustrate several embodiments of the method of storing and transporting boil-off gas and saturated vapor. The drawings and the preferred embodiments of the invention are presented with the understanding that the present invention is susceptible of embodiments in many different forms and, therefore, other embodiments may be utilized and structural, and operational changes may be made, without departing from the scope of the present invention.

The Processes

Figure 2:
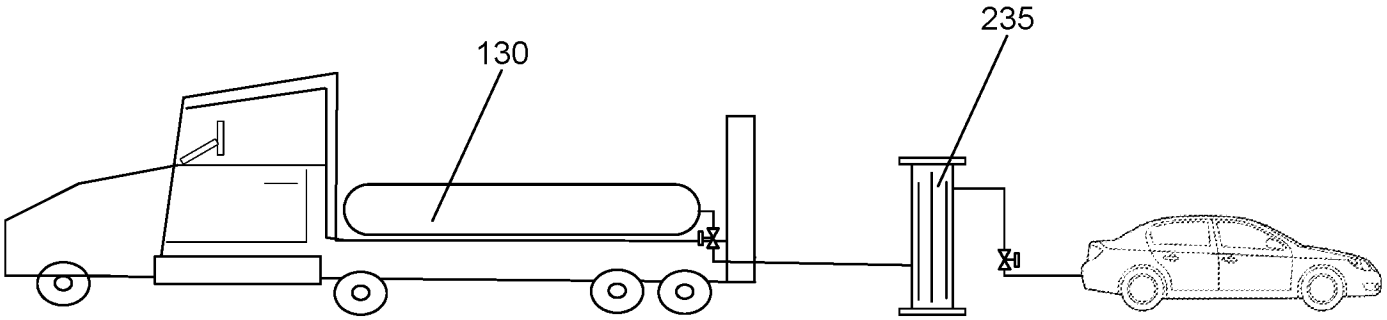
FIG. 2 is a schematic view of the delivery of gas from the ultra-low temperature, composite gas tank as a retail storage tank serving an end user.
Figure 3:
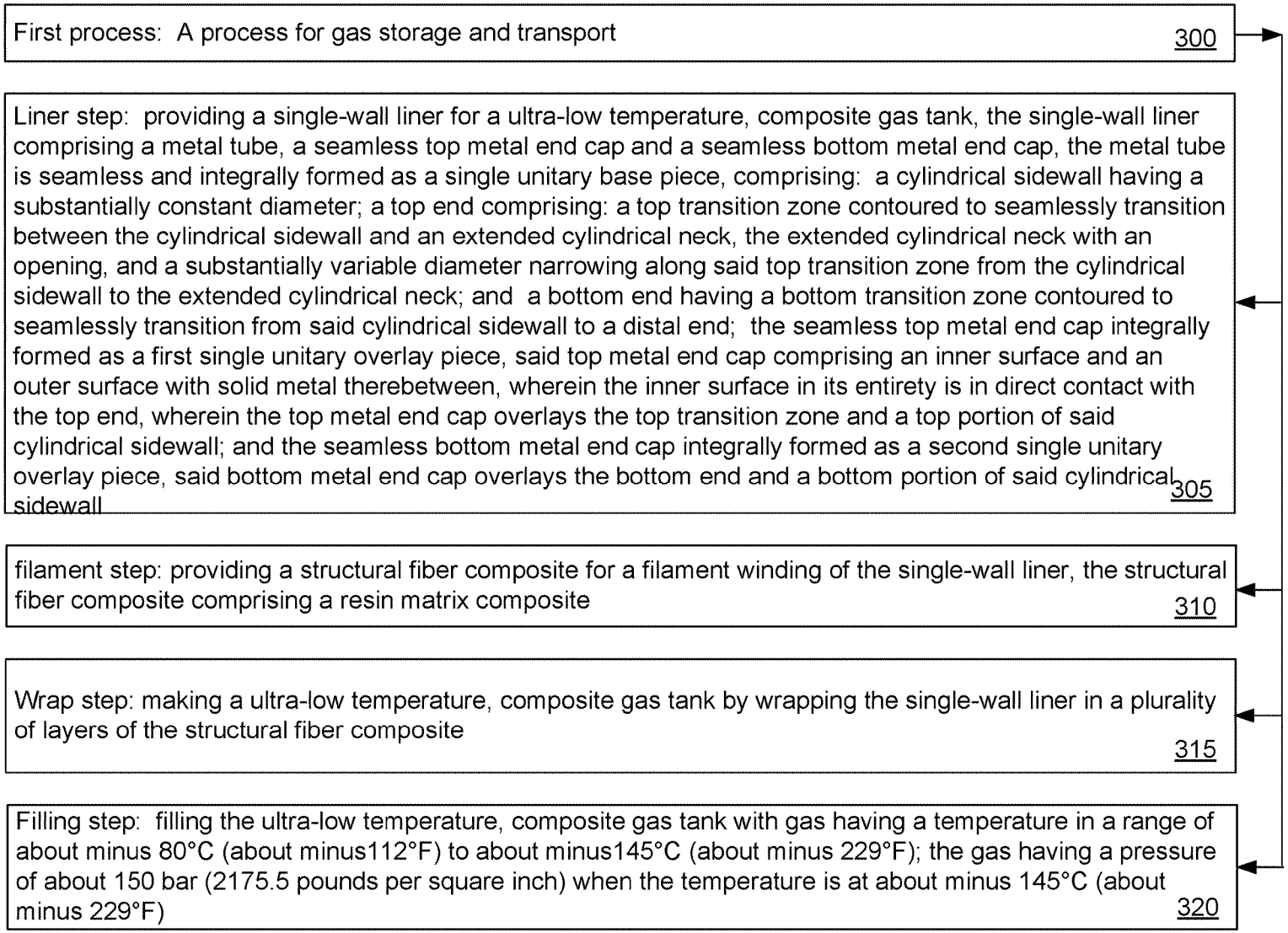
FIG. 3 is a flow chart showing required steps in a first process.
Figure 4:
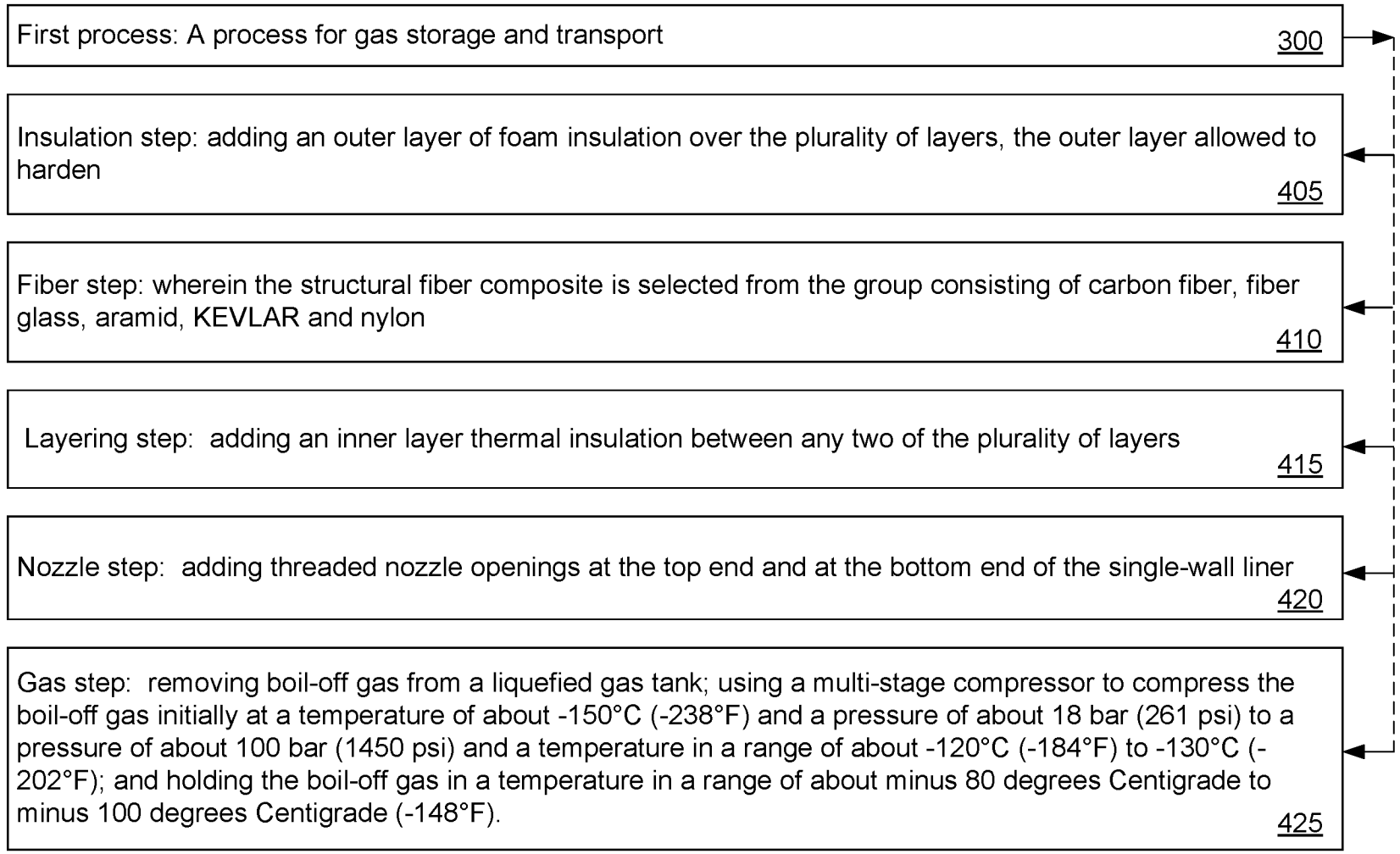
FIG. 4 is a flow chart identifying optional steps with a dashed line in the first process.
Figure 5:
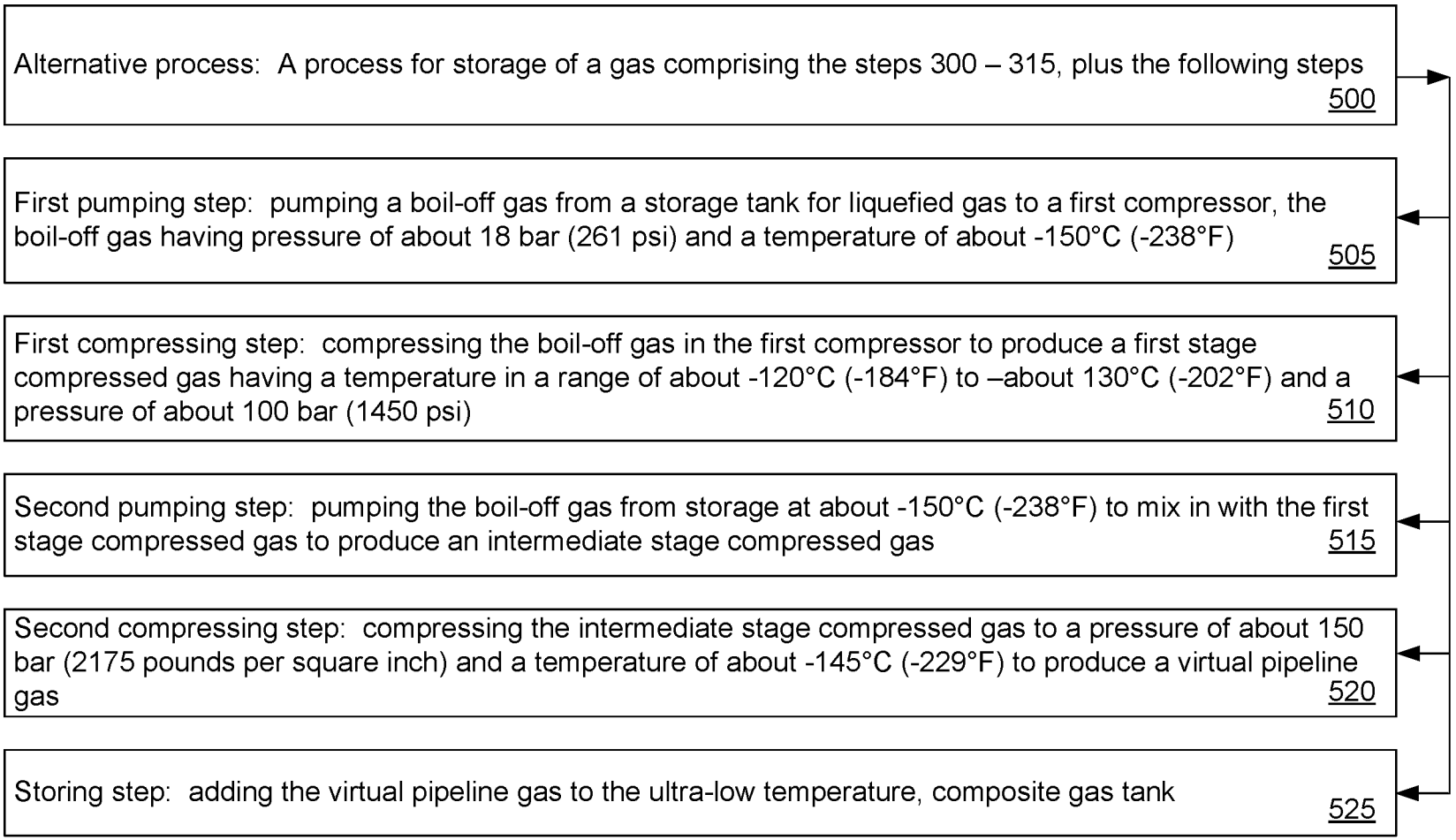
FIG. 5 is a flow chart showing required steps in a second process.

FIGS. 3 and 4 diagram a first process (300) that includes preferred steps and optional steps. FIG. 5 diagrams an alternative process (500) with preferred steps. The solid lines connecting boxes in FIG. 2 and FIG. 5's flow charts represent mandatory steps and dashed lines in FIG. 4 indicate optional steps. FIG. 3 shows all lines connecting the boxes are solid and are thus required steps. All of the boxes below the first process (300) in FIG. 4 are connected with a dashed line, indicating optional steps potentially added to the mandatory steps of FIG. 2.

The processes disclosed herein will have benefits for the storage and transportation of any gaseous and liquefied gas. Table 1 below lists typical gases and their boiling points for which storage and transportation benefits can be obtained from use of the ultra-low temperature, composite gas tank (130) according to this disclosure.

TABLE 1

| Chemical | Helium | Hydrogen | Nitrogen | Argon | Oxygen | LNG | Nitrous Oxide | Carbon Dioxide |
|---|---|---|---|---|---|---|---|---|
| Symbol/ Property | He | $H_2$ | $N_2$ | Ar | $O_2$ | $CH_4$ | $N_2O$ | $CO_2$ (Solid) |
| Boiling Point at 1013 mbar (° C.) | −269 | −253 | −196 | −186 | −183 | −161 | −88.5 | −78.5 |
| Liquid Density (Kg/Liter) | 0.124 | 0.071 | 0.808 | 1.42 | 1.142 | 0.42 | 1.23 | 11 |
| Gas Density at 15° C. (KG/M$^3$) | 0.169 | 0.085 | 1.18 | 1.69 | 1.35 | 0.68 | 3.16 | 1.87 |
| Gas Volume from 1 liter Liquid (Liter) | 748 | 844 | 691 | 835 | 853 | 630 | 662 | 845 |

The first process (300) includes a liner step (305); a filament step (310); a wrap step (315); and a filling step (320). Optional steps, shown in FIG. 4, include an insulation step (405); a fiber step (410); a layering step (415); a nozzle step (420); and a gas step (425).

The alternative process (500) includes the first three steps of the first process, namely the liner step (305); a filament step (310); a wrap step (315). The alternative process (500) includes a first pumping step (505); a first compressing step (510); a second pumping step (515); a second compressing step (520); and a storing step (525).

The Liner Step

The first step in the first process (300) and the alternative process (500) is a liner step (305). The single-wall liner (625) and the alternative single-wall liner (800), shown in FIG. 8 apply to the first process (300) shown in FIG. 3 and the alternative process (500), shown in FIG. 5. Both the first process (300) and the alternative process (500) use the single-wall liner (625) with its various optional components.

The liner step (305) involves the details in providing a single-wall liner (625) for an ultra-low temperature, composite gas tank. The single-wall liner (625) is also known as a "Metallic Liner with Metal End Caps for a Fiber Wrapped Gas Tank," as was described in U.S. Pat. No. 8,474,647, issued 2 Jul. 2013 and is hereby incorporated by reference herein in its entirety. The single-wall liner (625) is a component in the ultra-low temperature, composite gas tank (130) needed to implement a preferred claimed first process (300) and an alternative preferred claimed process (505), charted in FIG. 5.

Figure 1:
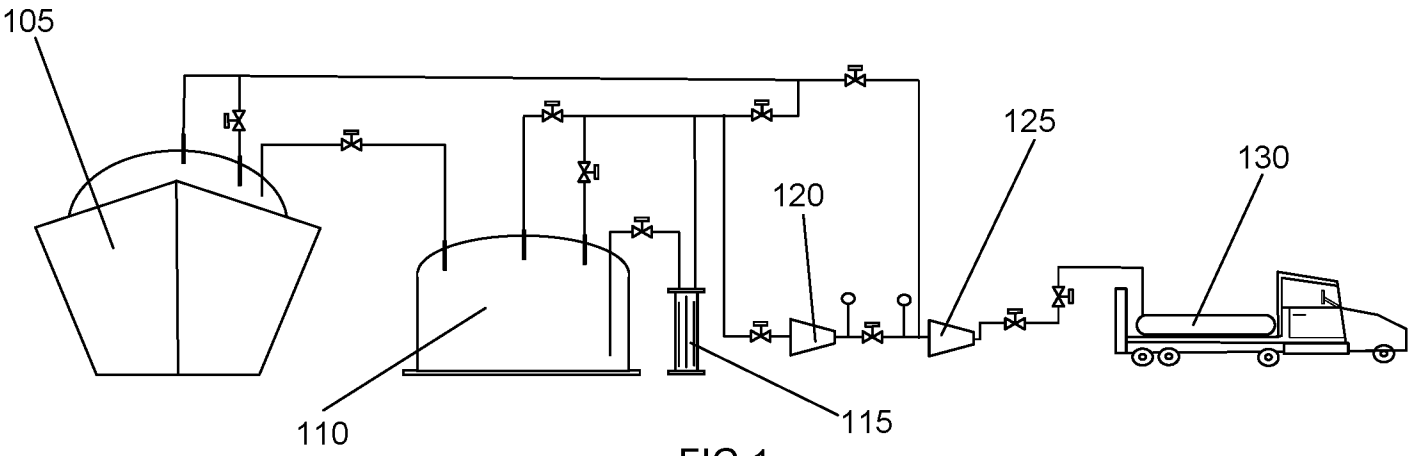
FIG. 1 is a schematic view of the components in a method of the invention.
Figure 7:
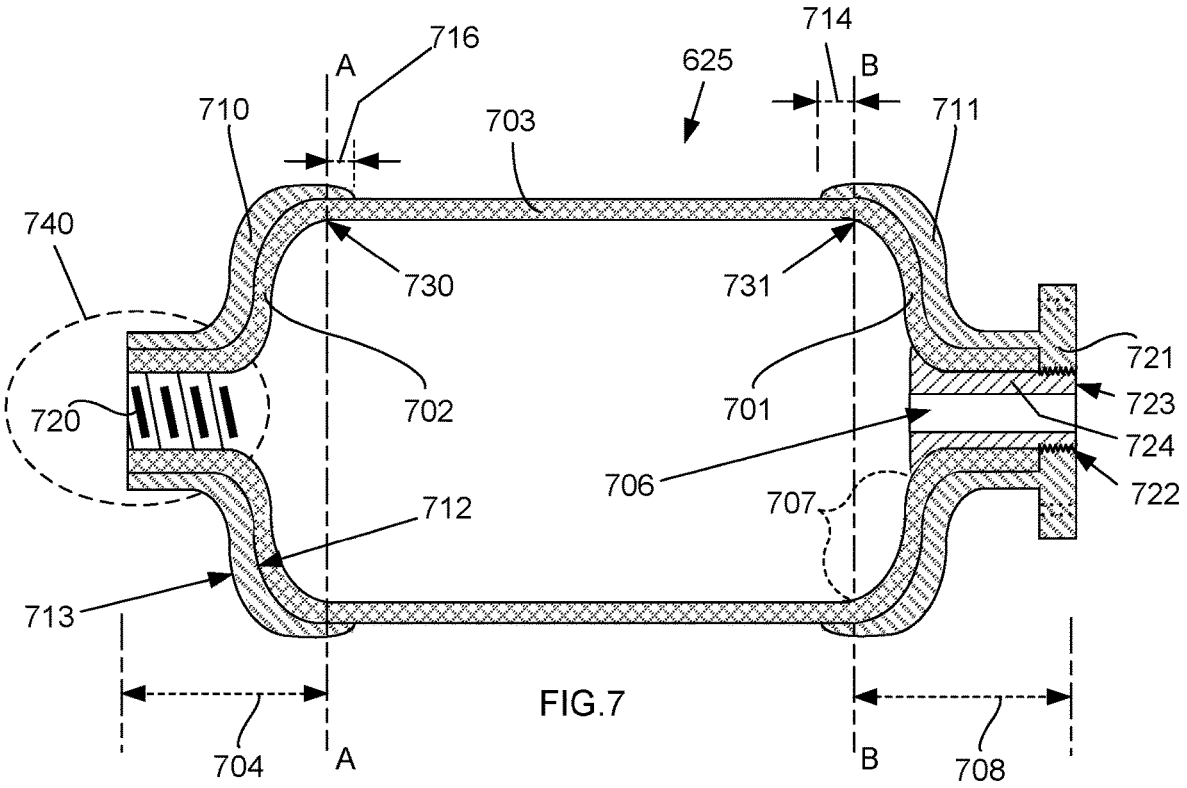
FIG. 7 is a side sectional view of a single-wall liner used according to the disclosure.
Figure 8:
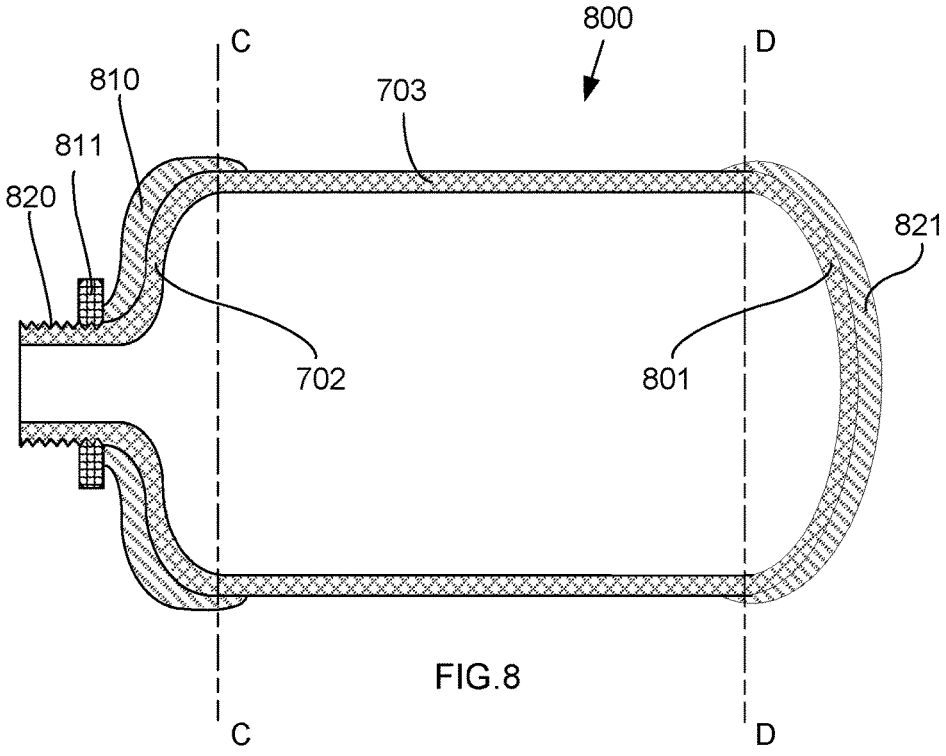
FIG. 8 is a side sectional view of an alternative single-wall liner with end caps used according to the disclosure.

FIG. 7 shows a sectional side view of a preferred embodiment of the single-wall liner (625). FIG. 8 shows a second preferred embodiment, that is an alternative single-wall liner (800). FIGS. 7 and 8, replicate FIGS. 1 and 2 of the '647 patent, modified with changed and added reference numbers.

The single-wall liner (625) that is first preferred is shown in FIG. 7 with three elements. The first element is a metal tube that is defined by cylindrical sidewall (703) (703), a top end (702) to the left of the line A-A, and a bottom end (701) to the right of line B-B. The second element of the single-wall liner (625) is a seamless top metal end cap (710). The third element of the single-wall liner (625) is a seamless bottom metal end cap (711).

The metal tube is seamless and integrally formed as a single unitary base piece of uniform thickness and uniform diameter. The top end (702) includes: a top transition zone (704) to the left of the line A-A in FIG. 7; and a bottom end (701) that includes a bottom transition zone (708) to the right of line B-B. These transition zones seamlessly transition between the cylindrical sidewall (703) and an extended cylindrical neck at each end, except as shown in FIG. 8, with a single extended cylindrical neck at the top end (702) and a closed bottom dome (801).

The top end (702) of the single-wall liner (625) is preferably contoured to form a top dome that seamlessly transitions from the cylindrical sidewall (703) beginning at location (730) to form an extended cylindrical neck, which is shown in the dashed oval (740).

The bottom end (701) of the single-wall liner (625) is preferably contoured to form a bottom dome that seamlessly transitions from the cylindrical sidewall (703) beginning at a second location (731) to form an extended cylindrical neck that is open with a hole (706) through a fitting (724) screwed into the extended cylindrical neck.

The top end (702) and the bottom end (701) have a substantially variable diameter (707) narrowing along these transitions zones from the cylindrical sidewall (703) to the extended cylindrical neck. The bottom end (701) has a bottom transition zone (708) contoured to seamlessly transition from said cylindrical sidewall (703) to a distal end (723).

Each extended cylindrical neck defines an opening into and out of the single-wall liner (625). The extended cylindrical neck preferably has internal threads (720), that is, threads within each extended cylindrical neck. Alternatively, any extended cylindrical neck may have external threads (820). The threads, whether internal or external or both, permit attaching an end cap, fitting or appurtenance.

Typical optional fittings for internal or external threads include, a valve, pressure regulator, stub, or end plug to terminate the opening. In addition, an external thread may be used with a lock nut (811) to secure an end cap, or the end cap itself may be threaded to mate with them. Optionally, the cylindrical neck surrounds a boss, that is, an embedded fitting, such as the solid boss.

The extended cylindrical neck of the bottom end shown in FIG. 7 has external threads that mate (722) with threads on a seamless bottom metal end cap (711) shaped with a flange (721). Alternative arrangements are possible such as a two-part flange with the external flat face screwed into the part embedded within the extended cylindrical neck. The flange (721) facilitates connecting multiple cylinders in series, that is, a tandem connection of cylinders to extend volume capacity.

The second element of the single-wall liner (625) is a seamless top metal end cap (710) having a mating shape to the top dome. The seamless top metal end cap (710) is of seamless construction, that is, it is a single integral piece of metal with no welds or seams of any kind. The seamless top metal end cap (710) is integrally formed as a first single unitary overlay piece, as shown in FIG. 7. The seamless top metal end cap (710) has an inner surface (712) and an outer surface (713) with solid metal therebetween. The inner surface is entirely in direct contact with the top end (702), wherein the seamless top metal end cap (710) overlays the top transition zone (704) to the left of the line A-A in FIG. 7, and a top portion (716) of said cylindrical sidewall (703) to the right of the line A-A in FIG. 7. Preferably, the seamless top metal end cap (710) is attachable to the top dome.

Preferably, the seamless top metal end cap (710) has a neck of same length as that of the extended cylindrical neck of the single-wall liner (625). However, it is not required that the end cap rise to the end of the extended cylindrical neck, as shown in the embodiment illustrated in FIG. 7, but may rise partly up the extended cylindrical neck as shown in FIG. 8 for the alternative seamless top metal end cap (810). Preferably, the seamless top metal end cap (710) also covers the start of the seamless transition from the cylindrical sidewall (703), and thus would preferably cover at least the top end (702) in its entirety. Optionally, an alternative seamless top metal end cap (810) has mating with external threads (820) on an extended cylindrical neck.

The third element of the single-wall liner (625) is a seamless bottom metal end cap (711), which is preferably similarly configured to the seamless top metal end cap (710). The seamless bottom metal end cap (711) is seamless and is integrally formed as a second single unitary overlay piece, as shown in FIG. 7. The seamless bottom metal end cap (711) overlays the bottom transition zone (708) to the right of the line B-B in FIG. 7 and a bottom portion (714) of said cylindrical sidewall (703) to the left of the line B-B in FIG. 7.

The fourth element of the liner is a seamless bottom metal end cap (711) having a mating shape of the bottom dome. The preferences and options for the seamless bottom metal end cap (711) parallel those of the seamless top metal end cap (710). FIG. 7 shows an optional fitting embedded within the extended cylindrical neck, which is shown threaded to flange (721). Optional embedded fittings are well known in the art and other examples include a cryogenic valve fitting (630), a nozzle and a plug. A plug is a solid boss.

The seamless bottom metal end cap (711) is of seamless construction, that is, it is a single integral piece of metal with no welds or seams of any kind.

The preferred metal for the metal tube, the seamless top metal end cap (710), and the seamless bottom metal end cap (711) is 6000 series aluminum alloy. Dissimilar metals may be used for each of these three elements, recognizing that dissimilar metals may involve deleterious effects from galvanic action. FIG. 10 is a chart listing temperature and pressure against the gas weight and other features of compressed natural gas (CNG) in a single-wall liner (625) or the ultra-low temperature, composite gas tank (130) according to the disclosure herein.

In sum, the liner step (305) includes providing a single-wall liner (625) for the ultra-low temperature, composite gas tank (130). The single-wall liner (625) includes a metal tube, a seamless top metal end cap (710) and a seamless bottom metal end cap (711). The metal tube is seamless and integrally formed as a single unitary base piece. The metal tube comprises a cylindrical sidewall (703) having a substantially constant diameter. The metal tube further comprises a top end (702). The top end (702) comprises a top transition zone (704) contoured to seamlessly transition between the cylindrical sidewall (703) and an extended cylindrical neck, which is shown in the dashed oval (740). The extended cylindrical neck defines an opening and has a substantially variable diameter narrowing along said top transition zone (704) from the cylindrical sidewall to the extended cylindrical neck. The metal tube has a bottom end (701), which defines a bottom transition zone (708) contoured to seamlessly transition from said cylindrical sidewall (703) to a distal end (723). The seamless top metal end cap (710) is integrally formed as a first single unitary overlay piece, as shown in FIG. 7. The seamless top metal end cap (710) defines an inner surface (712) and an outer surface (713) with solid metal therebetween, wherein the inner surface (712) in its entirety is in direct contact with the top end (702). The seamless top metal end cap (710) overlays the top transition zone (704) and a top portion (716) of said cylindrical sidewall (703). The metal tube further includes the seamless bottom metal end cap (711) integrally formed as a second single unitary overlay piece, as shown in FIG. 7. The seamless bottom metal end cap (711) overlays the bottom end (701) and a bottom portion (714) of the cylindrical sidewall (703).

The following table provides typical size and volume dimensions for a single-wall liner (625).

CYLNDER WATER VOLUME (NOMINAL) CALCULATIONS

| | | | | | | |
|---|---|---|---|---|---|---|
| CYLINDER OD (Nominal) | INCHES | 8.75 | 8.75 | 8.75 | 8.75 | 8.75 |
| CYLINDER ID Nominal) | INCHES | 7.75 | 7.75 | 7.75 | 7.75 | 7.75 |
| OVERALL LENGTH | INCHES | 60 | 72 | 84 | 100 | 120 |
| WATER VOLUME | LTERS | 44 | 54 | 63 | 75 | 91 |
| CYLINDER OD (Nominal) | INCHES | 11 | 11 | 11 | 11 | 11 |
| CYLINDER ID Nominal) | INCHES | 9.75 | 9.75 | 9.75 | 9.75 | 9.75 |
| OVERALL LENGTH | INCHES | 60 | 72 | 84 | 100 | 120 |
| WATER VOLUME | LTERS | 69 | 84 | 99 | 118 | 143 |

-continued

CYLNDER WATER VOLUME (NOMINAL) CALCULATIONS

| | | | | | | |
|---|---|---|---|---|---|---|
| CYLINDER OD (Nominal) | INCHES | 13.5 | 13.5 | 13.5 | 13.5 | 13.5 |
| CYLINDER ID Nominal) | INCHES | 11.5 | 11.5 | 11.5 | 11.5 | 11.5 |
| OVERALL LENGTH | INCHES | 60 | 72 | 84 | 100 | 120 |
| WATER VOLUME | LTERS | 95 | 116 | 136 | 164 | 198 |

The Filament Step

The next step in the first process (300) is the filament step (310). The filament step (310) includes providing a structural fiber composite for a filament winding (905) of the single-wall liner, the structural fiber composite comprising a resin matrix composite (910). Structural fibers are well known in the field. Optionally, the first process (300) may include a fiber step (410) wherein the structural fiber composite is selected from the group consisting of carbon fiber, fiber glass, aramid, KEVLAR and nylon. Structural fiber adds strength to the single-wall liner (625). This strength is needed to contain the high gas pressures capable of being experienced within the ultra-low temperature, composite gas tank (130). The ultra-low temperature, composite gas tank (130) is designed to withstand the hydrostatic and thermal in the circumferential (hoop), tangential or helical directions.

The Wrap Step

Figure 6:
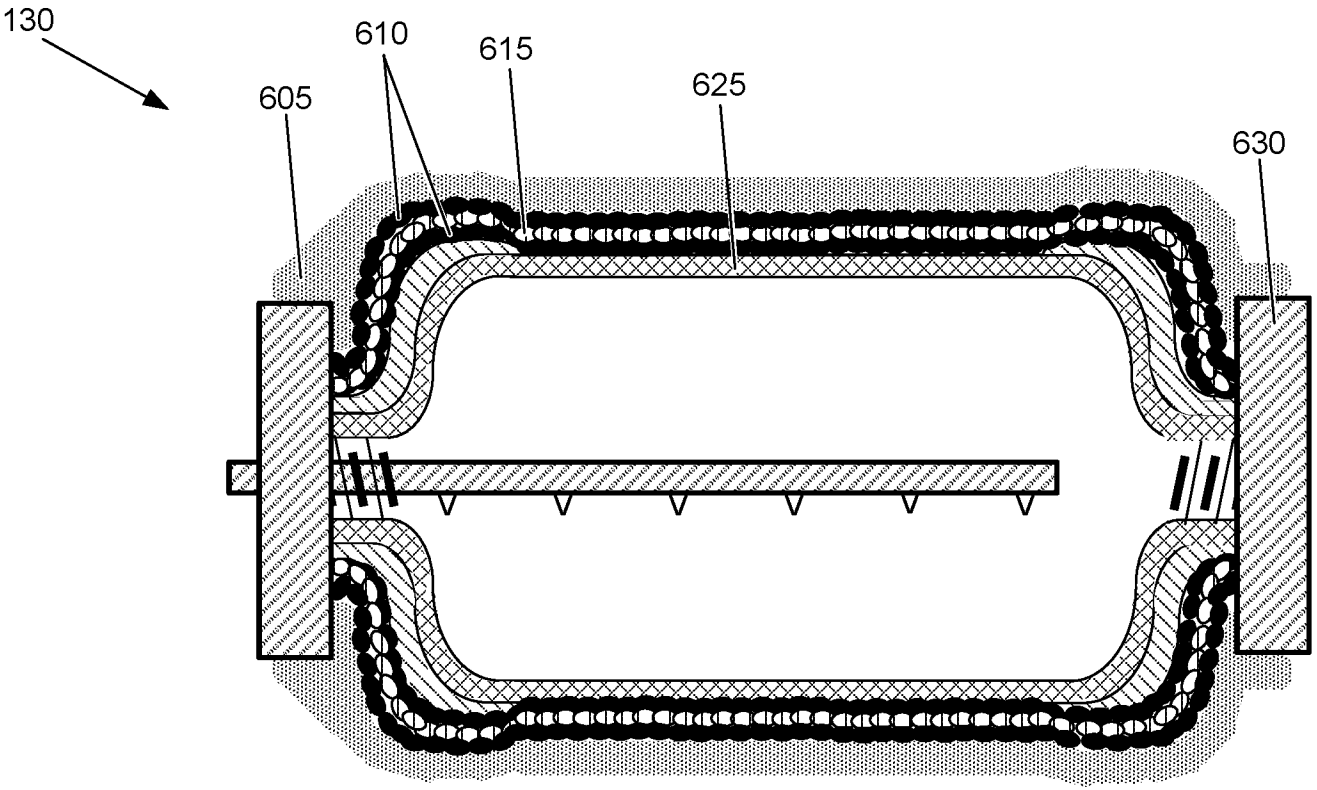
FIG. 6 is a side sectional view of an ultra-low temperature, composite gas tank according to the disclosure.

The next step in the first process (300) is the wrap step (315). The wrap step (315) includes making the ultra-low temperature, composite gas tank (130) by wrapping the single-wall liner (625) in a plurality of layers of the structural fiber (610), as shown in FIG. 6. Two such layers of the structural fiber (610) are shown in FIG. 6. By cross-weaving continuous rovings of carbon fiber, fiberglass and/or aramid fiber, and impregnating them in a thermosetting or thermoplastic resin matrix, the filament winding (905) results in an optimized ultra-low temperature, composite gas tank (130) for both ultra-low temperature and high pressure storage and transportation.

The next step in the first process (300) is the filling step (320). The filling step (320) includes filling the ultra-low temperature, composite gas tank (130) with gas having a temperature in a range of about minus 80° C. (about minus 112° F.) to about minus 145° C. (about minus 229° F.); the gas having a pressure of about 150 bar (2175.5 pounds per square inch) when the temperature is at about minus 145° C. (about minus 229° F.). The temperature range is approximate and may vary depending on the temperature of the boil-off gas (106) and the recompression machinery available. The initial temperature of the gas may be any temperature above the liquefaction temperature for the gas. For methane, the liquefaction temperature is about −162° C. (−259° F.) and so boil-off gas (106) would be above that temperature and likely about −145° C. (about −229° F.) at a pressure of about 18 bar (261 psi). So, for preferred loading conditions prior to storage in the ultra-low temperature, composite gas tank (130), the gas would preferably be compressed to about 150 bar (2175 psi) and a temperature of about −145° C. (about −229° F.).

Insulation Step

Figure 9:
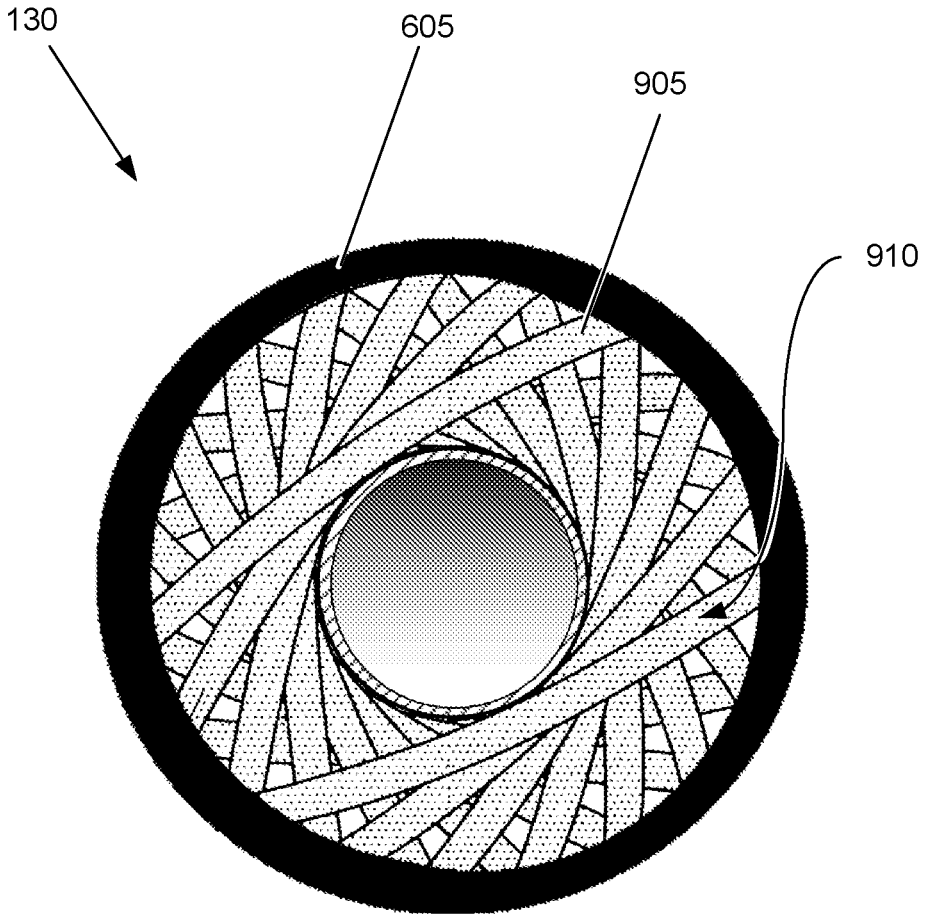
FIG. 9 is an end elevation view of the ultra-low temperature, composite gas tank according to the disclosure.

Optionally, the first process (300) may include an insulation step (405). The insulation step (405) includes adding an outer layer (605) of foam insulation over the plurality of layers. This is shown in FIG. 9. The outer layer (605) is preferably one that hardens into a solid. The process then allows the outer layer (605) to harden. Use of foam insulation in cryogenic and near cryogenic applications is well known. For example, spray-on foam insulation (SOFI) has been developed for use on the cryogenic tanks of space launch vehicles beginning in the 1960s with the Apollo program. Also, the Space Shuttle External Tank is covered with rigid polymeric closed-cell foam insulation to prevent ice formation, protect the metallic tank from aerodynamic heating, and control the breakup of the tank during re-entry.

Layering Step

Optionally, the first process (300) may include a layering step (415). The layering step (415) that includes adding an inner layer thermal insulation (615) between any two of the plurality of layers of the structural fiber (610), as shown in FIG. 6.

Nozzle Step

Optionally, the first process (300) may include a nozzle step (420). The nozzle step *420) includes adding threaded nozzle openings at the top end and at the bottom end of the single-wall liner (625).

Gas Step

Optionally, the first process (300) may include a gas step (425). The gas step (425) includes removing boil-off gas (106) from a liquefied gas tank; using a multi-stage compressor to compress the boil-off gas (106) initially at a temperature of about −150° C. (−238° F.) and a pressure of about 18 bar (261 psi) to a pressure of about 100 bar (1450 psi) and a temperature in a range of about −120° C. (−184° F.) to −130° C. (−202° F.); and holding the boil-off gas (106) in a temperature in a range of about minus 80 degrees Centigrade (−112° F.) to minus 100 degrees Centigrade (−148° F.).

Alternative Process

The alternative process (500) uses the same first three steps as the first process (300), namely the liner step (305); the filament step (310); and the wrap step (315) as described above.

First Pumping Step

The next step in the alternative process (500) is the first pumping step (505). The first pumping step (505) includes pumping a boil-off gas (106) from a storage tank for liquefied natural gas to a first compressor, the boil-off gas (106) having pressure of about 18 bar (261 psi) and a temperature of about −150° C. (−238° F.)

First Compressing Step

The next step in the alternative process (500) is the first compressing step (510). The first compressing step (510) includes compressing the boil-off gas (106) in the first compressor (120) to produce a first stage compressed gas having a temperature in a range of about −120° C. (−184° F.) to about 130° C. (−202° F.) and a pressure of about 100 bar (1450 psi). The first stage compressed gas is the gas that leaves the first compressor (120) shown in FIG. 1.

Second Pumping Step

The next step in the alternative process (500) is the second pumping step (515). The second pumping step (515) includes pumping the boil-off gas (106) from storage at about −150° C. (−238° F.) to mix in with the first stage compressed gas to produce an intermediate stage compressed gas. The storage source may be any such source, such as a liquefied natural gas transfer storage tank (115), a liquefied natural gas large storage tank (110), or the liquefied natural gas ship (105). The intermediate stage compressed gas is the gas that enters the second compressor (125), shown in FIG. 1.

Second Compressing Step

The next step in the alternative process (500) is the second compressing step (520). The second compressing step (520) includes compressing the intermediate stage compressed gas to a pressure of about 150 bar (2175 pounds per square inch) and a temperature of about −145° C. (−229° F.) to produce a virtual pipeline gas. The virtual pipeline gas is the gas that leaves the second compressor (125), shown in FIG. 1

Storing Step

The next step in the alternative process (500) is the storing step (525). The storing step (525) includes adding the virtual pipeline gas to the ultra-low temperature, composite gas tank (130). Once stored in the ultra-low temperature, composite gas tank (130), the ultra-low temperature, composite gas tank (130) can be used as long-term storage and transportation to an end-user.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the liquefied gas industry.

What is claimed is:

1. A process for gas storage and transport comprising the steps of:

providing a single-wall liner for an ultra-low temperature, composite gas tank, the single-wall liner comprising a metal tube, a seamless top metal end cap and a seamless bottom metal end cap, the metal tube is seamless and integrally formed as a single unitary base piece, comprising:

a cylindrical sidewall having a substantially constant diameter;

a top end comprising: a top transition zone contoured to seamlessly transition between the cylindrical sidewall and an extended cylindrical neck, the extended cylindrical neck with an opening that provides access into the ultra-low temperature, composite gas tank, and a substantially variable diameter narrowing along said top transition zone from the cylindrical sidewall to the extended cylindrical neck; and a bottom end having a bottom transition zone contoured to seamlessly transition from said cylindrical sidewall to a distal end;

the seamless top metal end cap integrally formed as a first single unitary overlay piece, said top metal end cap comprising an inner surface and an outer surface with solid metal therebetween, wherein the inner surface in its entirety is in direct contact with the top end, wherein the top metal end cap overlays the top transition zone and a top portion of said cylindrical sidewall; and the seamless bottom metal end cap integrally formed as a second single unitary overlay piece, said bottom metal end cap overlays the bottom end and a bottom portion of said cylindrical sidewall;

providing a structural fiber composite for a filament winding of the single-wall liner, the structural fiber composite comprising a resin matrix composite;

completing the ultra-low temperature, composite gas tank by wrapping the single-wall liner in a plurality of layers of the structural fiber;

moving a boil-off gas from storage for liquefied gas to a first compressor, the boil-off gas having pressure of 18 bar (261 psi) and a temperature of −150° C. (−238° F.);

compressing the boil-off gas in the first compressor to produce a first stage compressed gas having a temperature in a range of −120° C. (−184° F.) to −130° C. (−202° F.) and a pressure of 100 bar (1450 psi);

moving the boil-off gas from the storage at −150° C. (−238° F.) to mix in with the first stage compressed gas to produce an intermediate stage compressed gas;

compressing the intermediate stage compressed gas to a pressure of 150 bar (2175 pounds per square inch) and a temperature of −145° C. (−229° F.) to produce a virtual pipeline gas;

adding the virtual pipeline gas to the ultra-low temperature, composite gas tank; and allowing the temperature of the virtual pipeline gas within the ultra-low temperature, composite gas tank to warm to an ambient temperature up to 25° C. (77° F.), without releasing boil-off gas from the ultra-low temperature, composite gas tank.

2. The process of claim 1, further comprising the step of adding an outer layer of foam insulation over the plurality of layers, the outer layer allowed to harden.

3. The process of claim 1, wherein the structural fiber composite is selected from the group consisting of carbon fiber, fiber glass, aramid, KEVLAR and nylon.

4. The process of claim 1, further comprising the step of adding an inner layer thermal insulation between any two of the plurality of layers.

5. The process of claim 1, further comprising the step of adding threaded nozzle openings at the top end and at the bottom end of the single-wall liner.

* * * * *